United States Patent [19]

Hall et al.

[11] Patent Number: 4,538,876

[45] Date of Patent: Sep. 3, 1985

[54] ELECTRICAL CONNECTOR

[75] Inventors: William G. Hall, Shillington; Peter G. Boswell, Reading, both of England

[73] Assignee: Johnson Matthey PLC, London, England

[21] Appl. No.: 477,851

[22] Filed: Mar. 22, 1983

[30] Foreign Application Priority Data

Mar. 22, 1982 [GB] United Kingdom ..... 8208269

[51] Int. Cl.[3] ..... H01R 4/64; H01R 3/08

[52] U.S. Cl. ..... 339/118 R; 339/278 C; 373/36

[58] Field of Search ..... 339/118 R, 118 RY, 5 L, 339/8 L, 278 C; 373/36–38; 174/9 F; 252/518, 520, 521

[56] References Cited

U.S. PATENT DOCUMENTS 4,004,844 1/1977 Knapton et al. ..... 339/118 R
4,188,523 2/1980 Kawai et al. ..... 339/5 L X

OTHER PUBLICATIONS

R. T. Beyer et al., "The Viscosity of Liquid Metals", p. 433, in *Liquid Metals, Chemistry and Physics*, S. Z. Beer, Ed. Marcel Dekker, New York, 1972.

*Primary Examiner*—Gil Weidenfeld
*Assistant Examiner*—Steven C. Bishop
*Attorney, Agent, or Firm*—Cushman, Darby & Cushman

[57] ABSTRACT

This invention relates to electrical connection means. In particular, the invention is concerned with means for effecting electrical connection between two or more bodies in such a way that any small relative movement between the bodies when so connected will result in only small to negligible mechanical stresses being imposed on one or more of the bodies and/or on one or more component parts of the electrical connection means. Further, electrical connection means according to the invention are such that, in service, they do not suffer from at least one of the disadvantages associated with known, substantially stress-free, electrical connection means. In more detail an electrical connection means comprises an electrically conductive member or lug dipping into and making electrical contact with liquid conductive material contained in an electrically conductive reservoir, and means for at least reducing any tendency towards expulsion of the liquid conductive material from the electrically conductive reservoir.

20 Claims, 2 Drawing Figures

ELECTRICAL CONNECTOR

Figure 1:
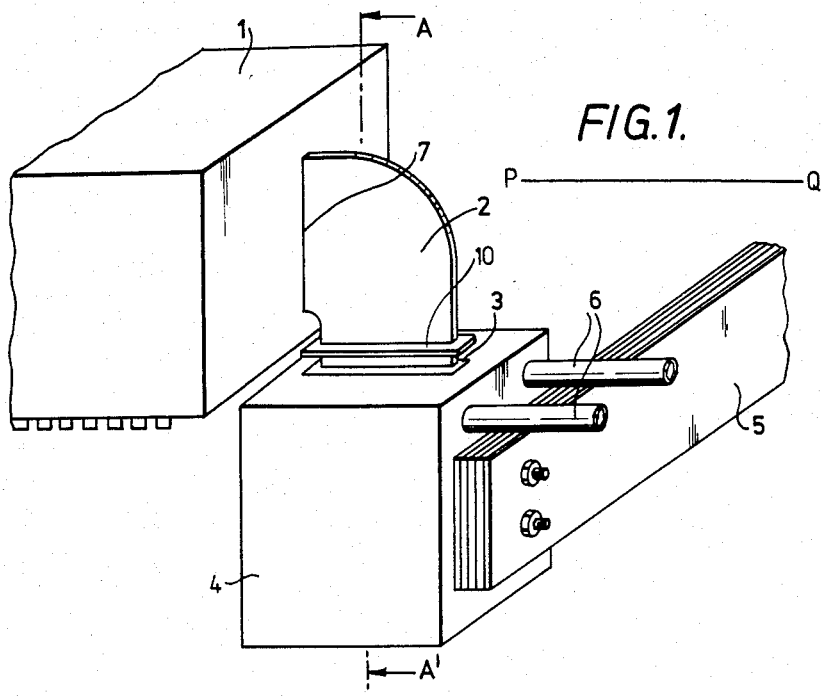

This invention relates to electrical connection means. In particular, the invention is concerned with means for effecting electrical connection between two or more bodies in such a way that any small relative movement between the bodies when so connected will result in only small to negligible mechanical stresses being imposed on one or more of the bodies and/or on one or more component parts of the electrical connection means. Further, electrical connection means according to the invention are such that, in service, they do not suffer from at least one of the disadvantages associated with known, substantially stress-free, electrical connection means.

Throughout the remainder to this specification, electrical connection means having the characteristics and capabilities set forth in the preceding paragraph will be referred to as "electrical connection means as herein described", or as "electrical connection means according to the invention, as herein described".

Electrical connection means according to the invention, as herein described are eminently suitable for use with or in equipment for the manufacture of glass fibres, although the invention is, of course, by no means so limited.

In the manufacture of glass fibres, molten glass in an open-topped container or trough (or "bushing", as it is commonly known in the industry), is allowed to flow through a multiplicity of fine nozzles in the base of the bushing. Thereafter, it is drawn into fibres, molten glass being added meanwhile to the bushing so as to maintain the head of glass in the bushing substantially constant.

The nozzles and also the bushing itself need to be resistant to attack by molten glass and for this purpose are commonly made from one or more platinum base alloys. Further, heat needs to be supplied to the glass in the bushing so as to maintain it in a molten state, at least while glass fibres ae being drawn.

In order to supply heat to the molten glass in the bushing at the required rate, an electric heating current is generally passed through the bushing but because the electrical resistances of the walls of a typical bushing are low, a very heavy current of the order of thousands of amperes is usually required. In fact, heating currents of 7,000 amperes and more are not at all uncommon and such currents are generally supplied via heavy rectangular cross-section conductors or lugs welded to opposite ends of the bushings.

Electrical connections are conventionally made to these lugs by means of bulky copper clamps, which are generally water-cooled, the opposite ends of the clamps being bolted in good electrical contact to heavy, current-carrying cables or bus-bars.

In service, the bushings are subject to dimensional changes due to thermal expansion and contraction and, as a result, considerable mechanical stresses are imposed on the lugs by the clamps. This has frequently led to the premature failure of the walls of bushings in the neighborhood of the junctions between these walls and the lugs.

This difficulty is overcome in apparatus of the type described and claimed in our British Pat. No. 1,527,980. In this apparatus, the conventional water-cooled clamps which connect one or more lugs secured to a container suitable for holding molten glass, such as a bushing, to a source of electric current, such as bus-bars or cables, are replaced by reservoirs containing electrically conductive material which is liquid at normal ambient temperatures and into which dip current-carrying conductors which are electrically connected to the container, the reservoirs, in turn, being electrically connected to a source of electric current, such as bus-bars or cables, each current-carrying conductor establishing and maintaining continuous electrical contact with its associated electrically conductive liquid material during movement of the container or of a part thereof relative to the reservoir.

One form of apparatus described and claimed in our British Pat. No. 1,527,980 is illustrated diagrammatically in the attached drawings, both of which have been taken from the published specification of the British patent just referred to, FIG. 1 with three minor additions, and of which, FIG. 1 is an isometric view of the equipment, and FIG. 2 is a section taken along the line AA′ of FIG. 1, the section plane containing the line AA′ running parallel to item 5 of FIG. 1.

In FIG. 1, a current-carrying conductor or lug 2, which is secured at position 7 to one end of a bushing 1, dips into an electrically conductive pool 3 of a 62 wt.% Ga, 25 wt% In, 13 wt% Sn eutectic alloy contained in a copper reservoir 4. This is, in turn, electrically connected to bus-bar 5.

The lug and the bushing are preferably made of a metal selected from the group consisting of ruthenium, rhodium, palladium, iridium, platinum, aluminium, copper, silver and gold; of an alloy of one or more of those metals with each other, or of an alloy of one or more of these metals with one or more other metals.

Figure 2:
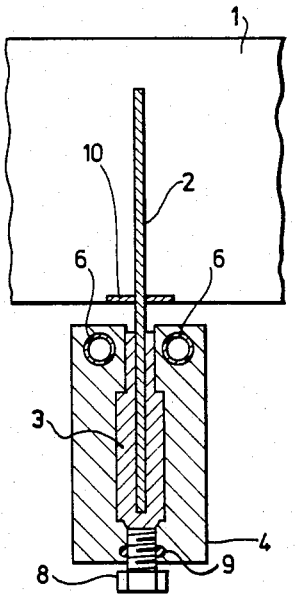

As will be seen from FIG. 2, the reservoir 4 is water-cooled, water being led into and out of a system of passageways in the body, of the reservoir by the tubes 6.

The apparatus is such that any small movement of the end face of the bushing 1 relative to the reservoir 4 and generally parallel to a substantially vertical plane containing the line PQ, will cause the lug to move through and/or up or down in the liquid 3, whilst maintaining electrical contact with it. Further, the apparatus is such that, during this movement, no significant mechanical stresses are imposed on the end wall of the bushing 1, on the junction 7 between this end wall and the conductive lug 2, on the lug itself or on the reservoir 4 and the bus-bar 5.

An additional advantage of the apparatus described is that control of temperature gradients near the ends of the bushing is very easily achieved.

It is important in practice that these temperature gradients should be as small as possible and, in prior art apparatus, this is done by the vertical adjustment of the water-cooled copper clamps on the lugs. In this way, the heat flow is these areas is varied until suitable conditions are obtained.

The adjustment just referred to is, however, a time-consuming and tedious process since it involves loosening and tightening the bolts of the water-cooled clamps with intervening small movements of the clamps on the lugs. Further, both of these operations may result in the overstressing of the bushing. In addition, the adjustment is carried out with the current switched off and also, it is often necessary to allow the lugs to cool, to an extent, before the clamps are moved. As a result, positioning the water-cooled clamps at the desired positions of the lugs can involve a good deal of down time for the bushing.

In the apparatus shown in FIG. 2, the adjustment is carried out by simply raising and lowering the level of the liquid metal 3 by means of the adjustable screw 8. A sealing gland 9 serves to prevent the escape of liquid metal. The process of adjustment is thus easily and quickly carried out and, in addition, it is not necessary in this case for the current to be switched off while adjustments are being made. Down time of the bushing whilst adjustments are made is thus virtually eliminated.

The apparatus described and claimed in British Pat. No. 1,527,980 has proved remarkably successful in achieving the ends for which it was principally designed, namely the elimination of any significant mechanical stresses on the end walls of a bushing and on other associated parts as previously described when the bushing or one or more parts thereof moves relatively to at least one reservoir containing the liquid metal into which the conductive lug dips.

We have now found, however, that difficulties do, on occasion, arise in practice. In particular, under certain circumstances, the liquid metal tends to be expelled from one or more of the reservoirs. We believe that this expulsion may initially be encouraged by the creep of the metal from the reservoir concerned up the lug by capillary or other action. The creep of the metal up one or more of the lugs is an effect we had anticipated and, in the original design, a metal fin or collar 10 (see FIGS. 1 and 2) was provided on each lug to prevent the metal from creeping too far up the lug and possibly attacking its surface in the region where the temperature of the lug is higher as a result of the passage of current through it.

Careful investigation has shown, however, that the expulsion of the liquid is ultimately due to the electromagnetic stirring of the liquid metal when current is flowing. Occasionally, stirring becomes intense in a localised area, as the result, for example, of the misalignment of the lug in the reservoir. This misalignment may take the form of one surface of the lug moving close to one wall of the reservoir with the result that there is a surge of current through and, in consequence, a vigorous stirring action in that portion of the liquid metal which is located between the lug surface and reservoir wall concerned. The heater current which is passed through a bushing is, for a given rate of input of heat, maintained essentially constant. It follows that if one surface of the lug moves closer to a wall of the reservoir as just described, a larger proportion of the current flowing along the lug will pass through the liquid metal located between the said surface of the lug and the reservoir wall and it is this which gives rise to a "surge" of current through the portion of the liquid metal between the lug surface and the reservoir wall.

According to the present invention there is provided electrical connection means as herein described, comprising an electrically conductive member or lug dipping into and making electrical contact with liquid conductive material contained in an electrically conductive reservoir, and means for at least reducing any tendency towards the expulsion of the liquid conductive material from the electrically conductive reservoir.

Preferably the means for reducing the said expulsion tendency may be achieved if one or more of the following conditions are satisfied:

(a) the viscosity of the liquid conductive material or of a portion thereof at the operating temperature is increased to a value significantly higher than its normal value at that temperature and preferably to a value at last three times as large as its normal value;

(b) the electrical power dissipated in the liquid conductive material per unit volume of this material, is reduced to a value below that at which expulsion occurs;

(c) the voltage gradients, that is, the electric fields between the lug and the inner walls of the reservoir are reduced to values below those at which expulsion occurs;

(d) the uniformity of the electric fields between the surfaces of the lug and the inner walls of the reservoir is improved by, for example, (i) rounding the edges of the lug, at least where it makes contact with the liquid conductive material;

(ii) rounding the internal corners of the reservoir at least over those parts of it which are in contact with the liquid conductive material, and (iii) making separate electrical connections between two or more outer surfaces of the reservoir and the bus bars or cables at points above the level of the floor of the inner cavity of the reservoir and below the level of the liquid conductive material in the reservoir;

(iv) the use of a reservoir divided into two or more portions along one or more planes containing the vertical axis of symmetry of the reservoir, the separate portions being clamped together with an electrically insulating gasket located between the abutting surfaces of the said portions so as to form watertight joints, with at least two separate electrical connections between each portion and the busbars or cables, the connections preferably being made, as in section (iii) above, to points on the outer surface or surfaces of each portion above the level of the floor of the inner cavity of the reservoir and below the level of the liquid conductive material in the reservoir and the gaskets being such that they do not interfere with the flow of cooling water through the body of the reservoir;

(e) the gaps between the surfaces of the lug and the inner surfaces of the reservoir are of sufficient widths for any displacement of the lug resulting from any expected movement of the container or bushing, or part thereof, to which the lug is secured, to be only a relatively small proportion of the gap or gaps which the movement reduces so that current surges will not occur or will at least be minimised.

According to a first aspect of the present invention, electrical connection means as herein described comprises one or more electrically conductive bodies or lugs dipping into and making electrical contact with a liquid, electrically conductive material contained in an electrically conductive reservoir, the arrangement being such that at least one of the conditions designated (a) to (e) in the immediately preceding paragraph is satisfied and the electrically conductive material being such that it is effectively inert to the material or materials of the or each lug and of the reservoir.

By the latter part of the immediately preceding sentence, including the expression "effectively inert" is meant that within the time scale of use of the electrical connection means no significant interaction will occur between the liquid electrically conductive material and the material or materials of the or each electrically conductive body or lug and of the reservoir.

The or each electrically conductive body or lug may be made (a) from a metal selected from the group ruthenium, rhodium palladium, iridium, platinum, aluminium, copper, silver, and gold, (b) from an alloy of one or more of these metals with each other, or (c) from an alloy of one or more of these metals with one or more other metals.

The reservoir may include means, such as a screw device, whereby the level of the liquid electrically conductive material within the reservoir may be raised or lowered at will.

Preferably, the liquid, electrically conductive material is a eutectic alloy having the composition 62 wt% gallium, 25 wt% indium, and 13 wt% tin. This alloy has a melting point lying between approximately 10° C. and approximately 12° C. and is therefore liquid at normal ambient temperature.

According to a second aspect of the invention, apparatus for the manufacture of glass fibres comprises a container suitable for holding molten glass and at least one connection means according to a first aspect of the invention whereby the container may be connected to a source of current.

Turning now to each of the conditions (a) to (e) referred to in the statement of a first aspect of the invention, (a) we have found that the viscosity of the 62 wt% gallium 25 wt% indium and 13 wt% tin alloy (this being a preferred form of the liquid, electrically conductive material) may be increased by adding to it a finely divided, inert powder, such as alpha or gamma alumina, magnesia, or titanium diboride, although powders of other oxides, borides, nitrides, silicides and carbides may, for example, be used.

Since these powders are inert, the melting point of the powder-loaded alloy will remain unchanged, although, in general, its electrical resistivity will increase. The increase of resistivity on adding titanium diboride to the alloy will be less marked than on adding the other materials, since titanium diboride is, to an extent, electrically conductive.

In our experiments, samples of the alloy were first made by melting tin gently in a porcelain dish and then adding appropriate quantities of indium and gallium. Differential thermal analysis confirmed that the melting points of such samples were between 10° C. and 12° C.

Samples of powder-loaded alloy were prepared by placing a small quantity of the powder in a screw-top jar and then adding the alloy a few drops at a time. After the addition of every few drops, the jar was shaken vigorously until the liquid alloy disappeared. As this took place, the powder gradually became darker as the alloy was either absorbed into the powder or formed a coating on the surface of the powder particles. Eventually the powder began to change into a paste and this process was completed when the particles would take up no more alloy.

We found that with alpha-alumina particles about 110 microns in diameter, the alloy constitutes from 67–73 volume % of the paste that is finally formed and, with gamma-alumina particles 0.05 micron in diameter, from 94–96 volume % of the paste. Once all the powder had been converted to paste, any further addition of the alloy merely produced a mixture of paste and liquid, with the paste floating on the top of the liquid.

The 0.05 micron gamma-alumina we used is sold as "Shandon Polishing Powder" and an attempt was made to measure the relative viscosities of paste made from this powder and the eutectic alloy and of the eutectic alloy alone, using a Ferranti-Shirley cone and plate viscometer. Problems were encountered with the paste because it showed strange surface tension effects and did not wet the cone and plate properly. Nevertheless, it was estimated that the shear strength of the paste was about five times that of the alloy.

Samples of the paste and the alloy were next tested in a rig comprising a 10 wt% rhodium/platinum alloy bar or lug held vertically at its upper end by a water-cooled copper clamp so that its lower end dipped into a cavity in the upper surface of a water-cooled, copper alloy pot or reservoir.

The lug was rectangular in cross-section and measured 2.0 cm by 0.4 cm, and the cavity, which had the shape of a rectangular prism, measured 2.7 cm by 1.3 cm by 2.5 cm deep. Finally, the lug was arranged with its lower end 0.5 cm from the floor of the cavity.

The copper clamp and reservoir were connected to a transformer capable of supplying a short term maximum current of 1500 amperes and for the purposes of the tests, samples of the alloy and the paste were placed in turn in the cavity to a depth of 2 cm, the cooling water turned on and the power switched on so as to supply a current of 1000 amps. The current was kept on during each test for a period of about five hours.

Stirring was observed when the alloy was in the cavity and no stirring when the paste was there. Further, we were able to satisfy ourselves that the stirring was due to the passage of the current and not to convection effects because, with the alloy in the cavity, stirring was observed immediately the current was switched on from cold and stopped immediately the current was switched off, when the alloy was hot. Further, very much more vigorous stirring was observed when the current was increased to 1300 amps and again this started immediately the current was switched on and then stopped immediately the current was switched off.

As previously indicated, each of the tests lasted for approximately five hours and it was observed, as expected, that the temperature of the paste was, in each case, higher on completion of the test than the temperature of the alloy. It was estimated that the resistivity of the alloy was about 50 micro-ohm.cm and that of the paste slightly more than this, but it did not appear that the temperature of the paste on completion of the test was entirely due to this difference in resistivity. It would seem rather, that part of the energy conveyed to the alloy by the electric current was dissipated as mechanical work whereas, in the case of the more viscous paste, stirring was resisted so that virtually all the electrical energy dissipated in the paste appeared as heat and was to a large extent retained there. Turning now to point (b), since the current passing through the lug, liquid metal and reservoir is, in practice, held substantially constant, the power dissipated in the liquid metal per unit volume cannot be reduced by increasing the gap between the lug and the sides of the reservoir. For example, if the width of the gap is initially W, the volume of liquid metal between the lug and the sides of the reservoir V, the resistance of this volume of metal between the lug and the reservoir walls R and the constant current I, then the power dissipated per unit volume of liquid metal is ($I^2R/V$). If now the width of the gap is increased by a factor k, the resistance becomes kR and the volume kV so that the power dissipated per unit volume is now $$\frac{I^2kR}{kV} = \frac{I^2R}{V},$$

which is the same as before.

The power dissipated per unit volume of liquid metal can, however, be reduced by increasing the depth of immersion of the lug in the liquid metal, whilst leaving the gap width (W) unchanged. Thus, if the depth of immersion of the lug is changed from d to kd, then, otherwise using the same symbols as before, the resistance R changes to (R/k) and the volume V to kV. It follows that the power dissipated per unit volume changes from $$\frac{I^2R}{V} \text{ to } \frac{I^2R}{k \cdot kV} = \frac{1}{k^2} \cdot \frac{I^2R}{V}$$

so that if k is greater than unity, there will be a reduction in the energy dissipated per unit volume.

(c) It was shown in the immediately preceding section (b) that the power dissipated per unit volume of the liquid metal cannot be changed by changing the gap between the lug and the inner walls of the reservoir. Similarly, the voltage gradients or electric fields between the surfaces of the lug and the inner walls of the reservoir cannot be changed by changing the widths of the gaps between them. Thus, using the same notation as in section (b), an increase in the gap width from W to kW changes the resistance from R to kR so that for a constant current I, the voltage drop is changed from IR to k.IR. Now, the field F is originally (IR/W) and, after the change of gap width, $$\frac{k \cdot IR}{k \cdot W} = \frac{IR}{W}$$

so that there is no change.

If, however, the depth of immersion of the lug is changed from d to kd, the gap width W staying the same, the resistance changes from R to (R/k) and the field from $$\frac{IR}{W} \text{ to } \frac{I}{W} \cdot \frac{R}{k} = \frac{1}{k} \cdot \frac{\{IR\}}{\{W\}}.$$

For values of k greater than unity, there is thus a reduction in the field strength. The requirements of conditions (b) and (c) may therefore be satisfied by increasing the depth of immersion of the conductive member or lug in the liquid metal or other liquid, electrically conductive material contained in the reservoir.

(d) The existence of sharp edges on the lug or sharp internal corners in the reservoir, or both, tends towards non-uniformity of the electric field, a condition that can predispose the apparatus to the expulsion of the liquid metal. It is for this reason that provision of (i) rounded edges on the lug, and (ii) rounded corners in the cavity is recommended for improving the uniformity of the field. Ideally, of course, the lug should be a rod of circular cross-section and the cavity into which the end of the lug passes should be in the form of a hollow cylinder.

The introduction of electric current separately to two or more of the outer sides of the reservoir (as in (iii)) and preferably to two or more points on each of the sides concerned so that the connections are above the level of the base of the cavity in the reservoir and below the level of the surface of the liquid in the cavity, also has the effect of improving the uniformity of the field.

(e) One or more surges of electric current capable of leading to the expulsion of the liquid metal will occur through the body of liquid metal located between a surface of the lug and a wall of the cavity if the lug surface moves relatively close to the reservoir wall so that the resistance of the body of liquid between them is significantly lower than the resistances of the bodies of liquid between the other three sides of the lug and the reservoir walls. It is for this reason that condition (e) requires the gap widths to be such that any normal or expected movement of the lug will be only a relatively small proportion of the gap or gaps which the movement reduces in width. Similar conditions apply if the lug is circular in cross-section and the reservoir in the form of a hollow cylinder.

Preferably, an expansion chamber is provided near the top of the reservoir to accommodate expansion of the liquid metal that might in exceptional circumstances occur.

If an expansion chamber is provided and the reservoir is equipped with means, such as the screw 8 in FIG. 2, whereby the level of the liquid metal may be adjusted for the purpose, for example, of controlling the temperature gradient at the end of a bushing, it is obviously necessary for the reservoir to be sufficiently deep to permit the upper level of adjustment of the liquid metal to be below the entrance to the expansion chamber.

Problems which can occur in practice are the creep of the liquid metal up the lug and the interaction between the liquid metal and the material of the lug especially in the higher temperature regions higher up the lug. In order to reduce the extent of creep, a fin as at 10 in FIGS. 1 and 2 may be provided. Preferably the fin is about 2 mm above the top surface of the reservoir.

Interaction between the liquid metal and the lug may be reduced by applying a protective metallic or nonmetallic coating to the lug or to those parts likely to be exposed to the liquid metal at a high temperature. A particularly vulnerable region is at the liquid air interface and the lug can with advantage be protected in this region by means of, for example, a coating of alumina or zirconia.

Although reference has been made in this specification to the use of connection means as herein described in association with a bushing for the manufacture of glass fibres, the invention is by no means so limited. Connection means according to the invention are, in fact, well adapted for use in any application where two or more bodies are required to be electrically interconnected and where these bodies are subject to small movements in relation to each other.

We claim:

1. An electrical connection comprising a metal reservoir in mechanically rigid contact with a current supplying busbar, the reservoir having walls; said reservoir containing: electrically conducting material comprising metal which is liquid at temperatures of operation; and a current carrying conductor dipping into the material to establish electrical contact therewith, and mounted for continuous electrical contact with the material during movement of the said current carrying conductor relative to the reservoir caused in use by thermal expansion and contraction of the container and the contents thereof; wherein the electrically conducting material also comprises a powder which is inert relative to the metal and the metal comprises from 67 to 96% by volume of the material whereby the viscosity of the material is increased thereby reducing any tendency towards expulsion of the material from the reservoir.

2. A combination according to claim 1, wherein the inert powder is finely divided and is selected from the group consisting of alpha alumina, gamma alumina magnesia, and titanium diboride.

3. A combination according to claim 2 wherein a sufficient volume of said powder is provided in said eletrically conducting material to increase the viscosity of the liquid conductive material so that it is at least three times greater than the normal viscosity thereof.

4. A combination according to claim 1 wherein the inert powder is finally divided and is selected from the group consisting of powders of oxides, borides, nitrides, silicides, and carbides effective to increase viscosity.

5. A combination as recited in claim 1 wherein said expulsion tendency reducing means further comprises means for controlling the electrical power dissipated in the liquid conductive material per unit volume to a value below that at which expulsion occurs.

6. A combination as recited in claim 5 wherein said expulsion tendency reducing means comprises means for adjusting the voltage gradients between the conductor and walls of said reservoir to a value below that at which expulsion occurs so as to establish a relatively uniform electric field in the reservoir of electrically conducting material.

7. A combination according to claim 6, wherein those edges of the conductor in the region of contact with the liquid conductive material are rounded.

8. A combination as recited in claim 7 wherein the reservoir includes internal corners, and wherein the internal corners of the reservoir in contact with the liquid conductive material are rounded.

9. A combination as recited in claim 6 wherein the reservoir includes internal corners, and wherein the internal corners of the reservoir in contact with the liquid conductive material are rounded.

10. A combination as recited in claim 1 wherein said reservoir includes two or more outer surfaces, and a floor, and further comprising separate electrical connections between two or more outer surfaces of said reservoir and external electrical conductors, said separate electrical connections being disposed at positions above the level of the floor of the reservoir and below the level of the liquid conductive material in the reservoir.

11. A combination as recited in claim 10 wherein said reservoir is divided into at least two portions along one or more planes containing the vertical axis of symmetry of the reservoir; and further comprising means for clamping said reservoir portions together with an electrically insulating gasket disposed between abutting surfaces of said portions, and means for providing separate electrical connections for each said portion.

12. In an electrical connection comprising a metal reservoir in mechanically rigid contact with a current supplying busbar, the reservoir having walls; said reservoir containing: electrically conducting material which is liquid at temperatures of operation; and a current carrying conductor dipping into the electrically connecting liquid to establish electrical contact therewith, and mounted for continuous electrical contact with the electrically conducting liquid during movement of the said current carrying conductor relative to the reservoir caused in use by thermal expansion and contraction of the container and the contents thereof; the improvement comprising:

a powder which is inert relative to the electrically conducting material and disposed therein, the powder significantly increasing the viscosity of at least a portion of the electrical conducting material.

13. A combination according to claim 12, wherein the inert powder is finally divided and is selected from the group consisting of alpha alumina, gamma alumina magnesia, and titanium diboride.

14. A combination according to claim 12 wherein the inert powder is finally divided and is selected from the group consisting of powders of oxides, borides, nitrides, silicides, and carbides effective to increase viscosity.

15. A combination according to claim 12 wherein a sufficient volume of said powder is provided in said electrically conducting material in increase the viscosity of the liquid conductive material so that it is at least three times greater than the normal viscosity thereof.

16. Apparatus comprising a container suitable for holding molten glass at high temperature and an electrical connection for connecting the container to a source of electric current, the connection comprising a metal reservoir in mechanically rigid contact with a current supplying busbar, said reservoir containing electrically conducting material comprising metal which is liquid at temperatures of operation and a current carrying conductor electrically connected to said container and dipping into the material during movement of said container relative to said reservoir caused in use by thermal expansion and contraction of the container and the contents thereof; wherein the material also comprises a powder which is inert relative to the metal and the metal comprises from 67 to 96% by volume of the material whereby the viscosity of the material is increased thereby reducing any tendency towards expulsion of the material from the reservoir.

17. Apparatus as recited in claim 16 wherein the inert powder is selected from the group consisting of alpha alumina, gamma alumina, magnesia, and titanium diboride.

18. Apparatus as recited in claim 16 wherein a sufficient volume of powder is provided in the liquid conductive material to increase the viscosity thereof so that it is at least three times greater than the normal viscosity thereof.

19. Apparatus as recited in claim 16 further comprising means for controlling the electrical power dissipated in the liquid conductive material per unit volume to a value below that at which expulsion of the liquid electrically conductive material occurs.

20. Apparatus as recited in claim 16 wherein the reservoir includes walls; and further comprising means for adjusting the voltage gradients between the conductor and walls of said reservoir to a value below that at which expulsion of the liquid conductive material occurs, so as to establish a relatively uniform electric field in the reservoir of liquid electrically conducting material.

* * * * *